US008052467B1

(12) United States Patent
Xie et al.

(10) Patent No.: US 8,052,467 B1
(45) Date of Patent: Nov. 8, 2011

(54) ELECTRICAL CONNECTOR

(75) Inventors: Bao-Geng Xie, Guang-Dong (CN); Ni Gao, Guang-Dong (CN); Wei-Hong Liao, Guang-Dong (CN); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/977,044

(22) Filed: Dec. 22, 2010

(51) Int. Cl.
*H01R 13/40* (2006.01)

(52) U.S. Cl. ..... 439/589; 439/607.27

(58) Field of Classification Search ..... 439/587, 439/83, 79, 271, 589, 607.13, 607.27, 607.28
See application file for complete search history.

(56) References Cited

U.S. PATENT DOCUMENTS 6,863,569 B2 * 3/2005 Zhu et al. ..... 439/607.27

* cited by examiner

*Primary Examiner* — Javaid Nasri
(74) *Attorney, Agent, or Firm* — Cheng-Ju Chiang

(57) ABSTRACT

An electrical connector includes an inner shell, an insulating housing, a plurality of terminals disposed in the insulating housing, an insulating jacket and an outer shell. The inner shell is looped from a metal plate to define an accommodating chamber therein and form a joint at a first top plate thereof. Two portions of the first top plate are punched outward to form two hollow receiving hats. The insulating housing is fastened in the accommodating chamber. The insulating jacket includes a first frame substantially airtightly surrounding the inner shell and a covering piece protruded frontward from a front of a top part of the first frame for covering the joint and locating between the receiving hats. The outer shell surrounds and electrically connects with the inner shell. The outer shell has at least one soldering arm soldered to the printed circuit board for achieving a ground function.

20 Claims, 4 Drawing Sheets

ELECTRICAL CONNECTOR

BACKGROUND OF THE INVENTION

1. Field of the Invention

The present invention relates to an electrical connector, and more particularly to an electrical connector capable of improving waterproof performance thereof.

2. The Related Art

A traditional electrical connector generally includes an insulating housing, a plurality of terminals disposed in the insulating housing, and a shielding shell. The insulating housing defines a plurality of wedges. The shielding shell includes an upper shell and a lower shell engaged with the upper shell. The upper shell and the lower shell respectively define a plurality of clipping grooves. When the electrical connector is assembled, the upper shell and the lower shell are engaged with each other with the wedges being fastened in the clipping grooves to surround the insulating housing.

However, if the upper shell and the lower shell are not engaged tightly, then a gap may be formed between the insulating housing and the shielding shell. A chink may be formed between the wedge and the clipping groove. The moisture may enter the shielding shell of the electrical connector from the gap and the chink to result in a short circuit to affect transmission quality.

SUMMARY OF THE INVENTION

An object of the present invention is to provide an electrical connector for being mounted to a printed circuit board. The electrical connector includes an inner shell, an insulating housing, a plurality of terminals, an insulating jacket and an outer shell. The inner shell is looped from a metal plate to define an accommodating chamber therein. The insulating housing is fastened in the accommodating chamber. The terminals are disposed in the insulating housing. The insulating jacket substantially airtightly surrounds the inner shell. The outer shell surrounds and electrically connects with the inner shell. The outer shell has at least one soldering arm soldered to the printed circuit board for achieving a ground function.

Another object of the present invention is to provide an electrical connector for being mounted to a printed circuit board. The electrical connector includes an inner shell, an insulating housing, a plurality of terminals, an insulating jacket and an outer shell. The inner shell is looped from a metal plate to define an accommodating chamber therein and form a joint at a substantial middle of a first top plate thereof. Two sides of the first top plate are punched outward to form two hollow receiving hats. The insulating housing is fastened in the accommodating chamber. The terminals are disposed in the insulating housing. The insulating jacket includes a first frame substantially airtightly surrounding a rear of the inner shell and a covering piece protruded frontward from a middle of a front of a top part of the first frame for covering the joint of the inner shell and locating between the receiving hats. The outer shell surrounds and electrically connects with the inner shell. The outer shell has at least one soldering arm soldered to the printed circuit board for achieving a ground function.

As described above, the first frame of the insulating jacket airtightly surrounds the rear of the inner shell and the covering piece covers the joint of the first top plate to avoid moisture entering the inner shell of the electrical connector. Furthermore, the inner shell has two hollow receiving hats for avoiding the moisture accumulating in the accommodating chamber.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
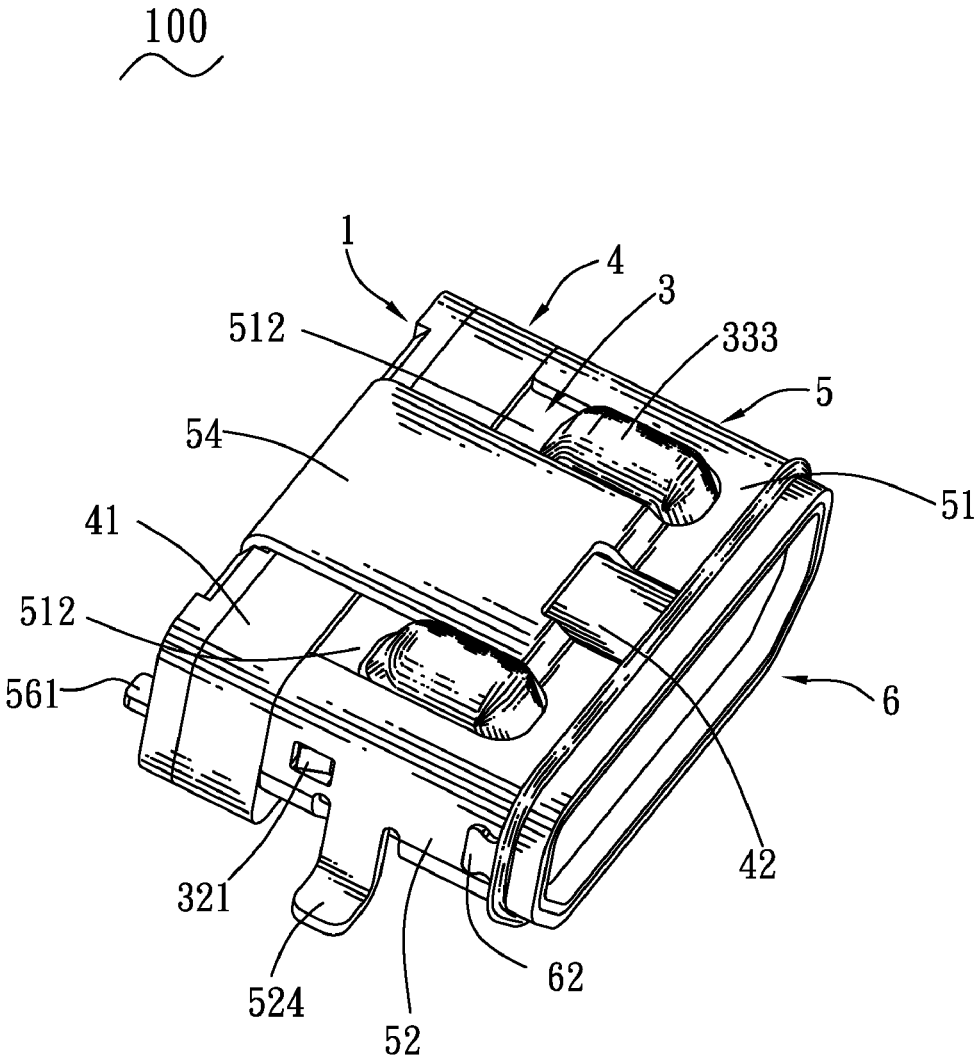
FIG. 1 is a perspective view of an electrical connector according to the present invention.
Figure 2:
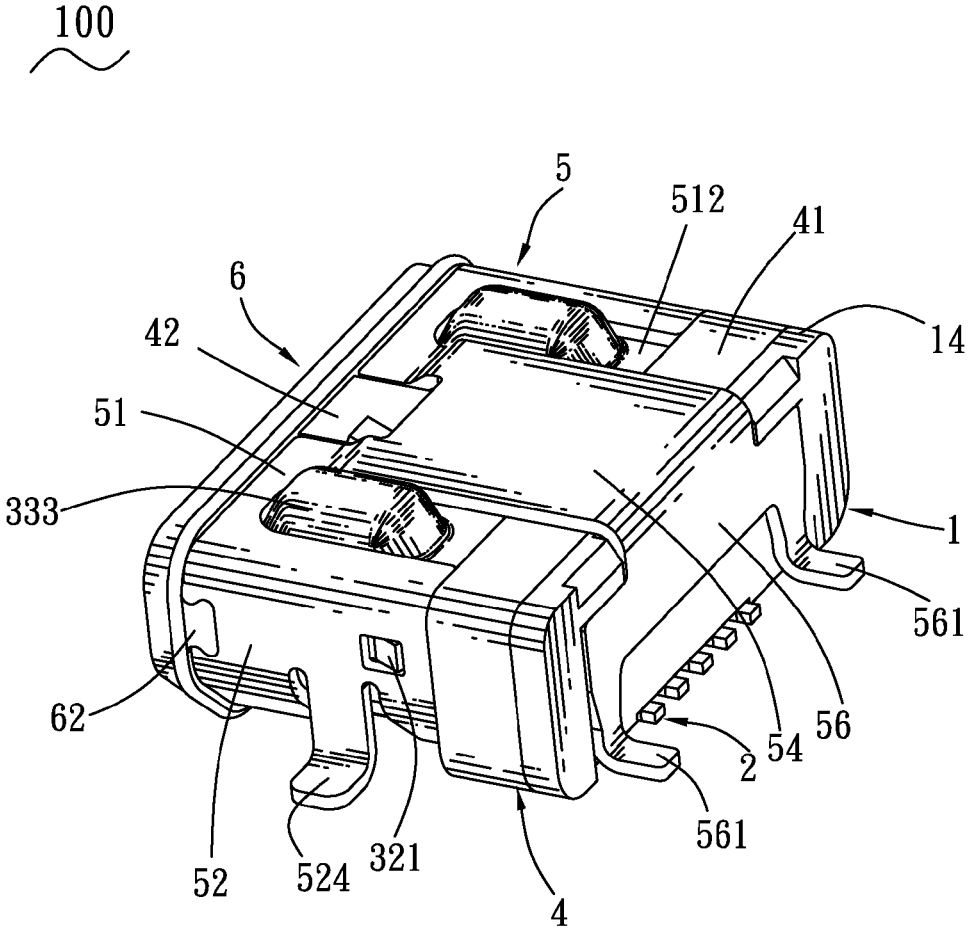
FIG. 2 is another angle perspective view of the electrical connector of FIG. 1.
Figure 3:
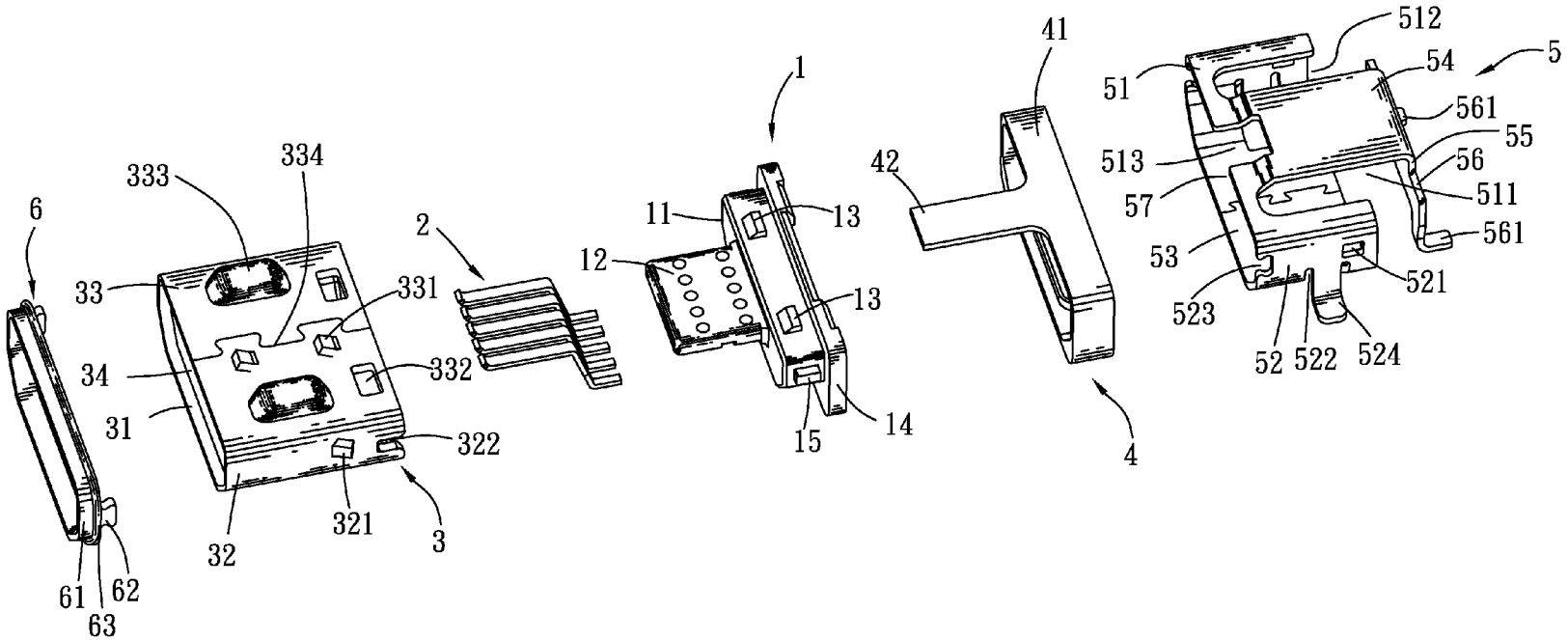
FIG. 3 is an exploded view of the electrical connector of FIG. 1.
Figure 4:
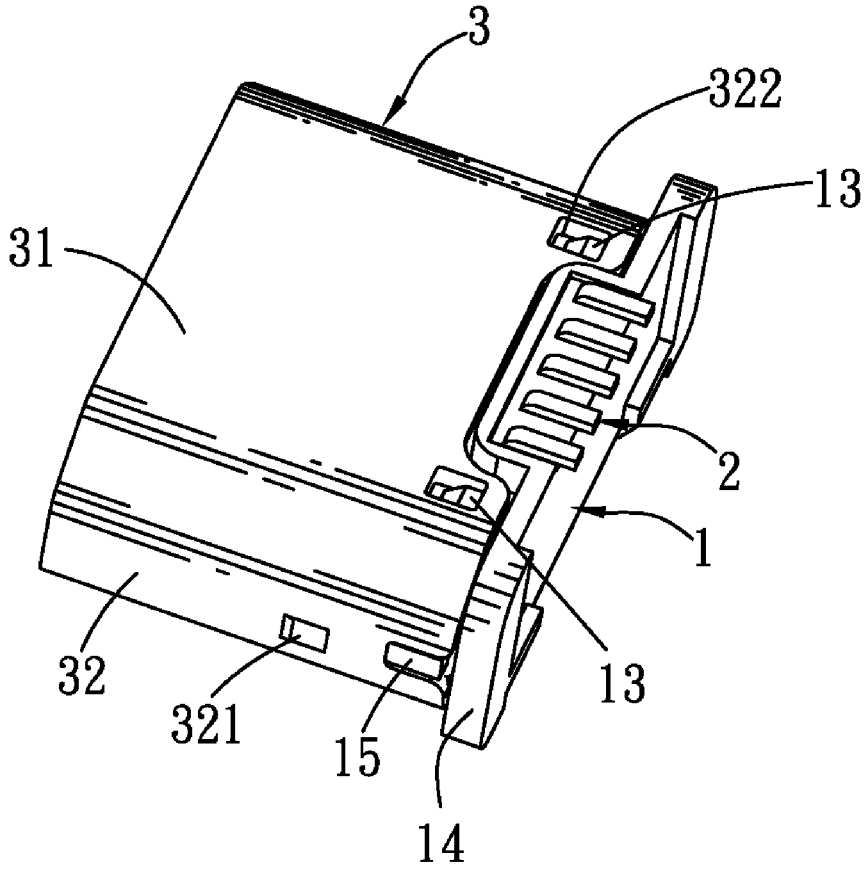
FIG. 4 is a partial assembling view of the electrical connector of FIG. 1.

Referring to FIG. 1 and FIG. 3, an electrical connector 100 according to the present invention is adapted for being mounted to a printed circuit board (not shown). The electrical connector 100 includes an insulating housing 1, a plurality of terminals 2 disposed in the insulating housing 1, an insulating jacket 4, a shielding shell (not labeled) and a waterproof rubber ring 6.

Referring to FIG. 3, the insulating housing 1 has a base body 11 of a substantially rectangular shape and a tongue portion 12 protruded forward from a front of the base body 11. Several portions of a top and a bottom of the base body 11 protrude outward to form a plurality of wedges 13, respectively. Two sides of the base body 11 protrude outward to form two positioning blocks 15. A blocking wall 14 is protruded outward and transversely surrounds a periphery of a rear end of the base body 11 of the insulating housing 1.

Referring to FIG. 3, the insulating jacket 4 has a rectangular ring-shaped first frame 41, and a covering piece 42 protruded forward from a middle of a front of a top part of the first frame 41.

Referring to FIG. 3, the shielding shell (not labeled) includes an inner shell 3, and an outer shell 5 surrounding the inner shell 3 and electrically connects with the inner shell 3.

Referring to FIG. 3, the inner shell 3 is made of metal plate, and is of a rectangular ring-shape with an accommodating chamber 34 formed therein. The inner shell 3 has a first bottom plate 31. Two first side plates 32 are extended upward from two opposite side edges of the first bottom plate 31. Two top edges of the two first side plates 32 extend towards each other to form a first top plate 33 with a joint 334 being formed at a substantial middle thereof. Two portions of the first top plate 33 are punched upward to form two spaced fastening blocks 331 located at a same side of the joint 334 and arranged longitudinally. Rear ends of the first top plate 33 and the first bottom plate 31 define a plurality of fastening holes 332, respectively. Two sides of the top plate 33 are punched oppositely to the accommodating chamber 34 to form two hollow receiving hats 333 for avoiding the moisture accumulating in the accommodating chamber 34. Each first side plate 32 is punched outward to form a buckling block 321, and defines a gap 322 at a rear end edge thereof.

Referring to FIG. 3, the outer shell 5 is made of metal plate, and has a second top plate 51. Two second side plates 52 are extended downward from two opposite side edges of the top plate 51. Each side plate 52 defines a buckling hole 521, an opening 522 below the buckling hole 521, and a clipping groove 523 passing through a front end thereof. A top end edge of the opening 522 is extended downward, and then is bent outward to form a first soldering arm 524. Two bottom edges of the two second side plates 52 extend towards each other to form a pair of second bottom plates 53 engaged with each other. The second top plate 51 defines a mouth 511 passing through a rear end thereof. A middle of a front end of the mouth 511 inclines upward, and then extends rearward to form a cover 54. Two fixing grooves 512 are formed adjacent to two opposite sides of the cover 54, respectively. An inserting space 57 is formed among the second top plate 51, the cover 54, the second side plates 52 and the second bottom plates 53. A middle of a front end of the cover 54 defines an inserting groove 513 passing through a front end of the second top plate 51. Before assembling the outer shell 5 to the electrical connector 100, a rear end of the cover 54 is connected with a connecting plate 55 horizontally, and a middle of a rectangular rear plate 56 is connected with the connecting plate 55 horizontally to beyond a rear edge of the outer shell 5. Two ends of a bottom of the rear plate 56 extend horizontally, and then are bent upward to form two second soldering arms 561, respectively. After assembling the outer shell 5 to the electrical connector 100, the connecting plate 55 and the rear plate 56 are bent downward. The two second soldering arms 561 respectively show straight L shape.

Referring to FIG. 3 again, the waterproof rubber ring 6 has a rectangular ring-shaped second frame 61. Two ends of a rear edge of a periphery of the second frame 61 extend rearward to form two clipping pieces 62. A rear end of the periphery of the second frame 61 is protruded outward to form a ring-shaped blocking rib 63.

Referring to FIGS. 1-4, when the electrical connector 100 is assembled, the first frame 41 of the insulating jacket 4 substantially airtightly surrounds a rear end of the inner shell 3. The covering piece 42 covers the joint 334 of the first top plate 33 and is located between the receiving hats 333. The fastening blocks 331 are against the covering piece 42. The insulating housing 1 is fastened in the accommodating chamber 34. The wedges 13 are inserted into the fastening holes 332, and the positioning blocks 15 are fastened in the gaps 322. The first frame 41 of the insulating jacket 4 covers the wedges 13 and the fastening holes 332, and the positioning blocks 15 and the gaps 322. A rear edge of the first frame 41 of the insulating jacket 4 and a rear edge of the inner shell 3 are against a front of the blocking wall 14. The inner shell 3 together with terminals 2, the insulating housing 1 and the insulating jacket 4 is inserted into the inserting space 57 of the outer shell 5 from a rear thereof until the receiving hats 333 are positioned in the corresponding fixing grooves 512 of the outer shell 5 and a front edge of the first frame 41 of the insulating jacket 4 is against rear edges of the second top plate 51, the second side plates 52 and the second bottom plates 53 of the outer shell 5. The buckling blocks 321 are inserted into the buckling holes 521. The cover 54 covers on the covering piece 42, the first frame 41 and the blocking wall 14. A front of the covering piece 42 is extended in the inserting groove 513 of the outer shell 5 and is flush with a front of the second top plate 51. Then, the connecting plate 55 is bent downward to make the rear plate 56 engaged in a rear of the blocking wall 14. The second frame 61 of the waterproof rubber ring 6 is bound around a front end of the inner shell 3 with the front edges of the covering piece 42 and the outer shell 5 abutting against a rear of the blocking rib 63 for avoiding the moisture entering between the outer shell 5 and the inner shell 3 along a front of the electrical connector 100. The clipping pieces 62 are wedged in the clipping grooves 523 tightly. The first soldering arms 524 and the second soldering arms 561 are soldered to the printed circuit board (not shown).

As described above, the first frame 41 of the insulating jacket 4 surrounds the rear end of the inner shell 3 to cover the wedges 13 and the fastening holes 332, and the positioning blocks 15 and the gaps 322, and the covering piece 42 covers the joint 334 of the first top plate 33 so as to avoid the moisture entering the inner shell 3 of the electrical connector. The waterproof rubber ring 6 is bound around the front of the inner shell 3 with the front edges of the covering piece 42 and the outer shell 5 abutting against a rear of the blocking rib 63 for avoiding the moisture entering between the outer shell 5 and the inner shell 3 along the front of the electrical connector 100. Furthermore, the inner shell 3 has two hollow receiving hats 333 for avoiding the moisture accumulating in the accommodating chamber 34.

What is claimed is:

1. An electrical connector for being mounted to a printed circuit board, comprising:

an inner shell looped from a metal plate to define an accommodating chamber therein;

an insulating housing fastened in the accommodating chamber;

a plurality of terminals disposed in the insulating housing;

an insulating jacket substantially airtightly surrounding the inner shell; and an outer shell surrounding and electrically connecting with the inner shell, the outer shell having at least one soldering arm soldered to the printed circuit board for achieving a ground function;

wherein the insulating housing has a base body, the base body has a plurality of wedges protruded outward therefrom, the inner shell define a plurality of fastening holes for receiving the wedges, the insulating jacket covers the wedges and the fastening holes.

2. The electrical connector as claimed in claim 1, wherein the insulating jacket includes a first frame substantially airtightly surrounding a rear of the inner shell and a covering piece protruded frontward from a middle of a front of a top part of the first frame for covering a joint of the inner shell formed in a first top plate thereof.

3. The electrical connector as claimed in claim 1, wherein two sides of the base body defines two positioning blocks, respectively, rear ends of two sides of the inner shell defines two gaps for receiving the corresponding positioning blocks.

4. The electrical connector as claimed in claim 1, wherein the insulating housing has a base body, a blocking wall is protruded outward from and surrounds a periphery of a rear end of the base body, rear edges of the insulating jacket and the inner shell are against a front of the blocking wall.

5. The electrical connector as claimed in claim 4, wherein a rear edge of the outer shell is against a front edge of the insulating jacket.

6. The electrical connector as claimed in claim 5, further comprising a waterproof rubber ring around a front end of the inner shell and against a front edge of the outer shell.

7. The electrical connector as claimed in claim 6, wherein the waterproof rubber ring includes a frame which is around a front end of the inner shell, a rear edge of a periphery of the waterproof rubber ring protruding outward to form a ring-shaped blocking rib abutting against the front edge of the outer shell.

8. The electrical connector as claimed in claim 6, wherein two ends of a rear edge of the waterproof rubber ring extend rearward to form two clipping pieces, the outer shell has two second side plates each of which defines a clipping groove passing through a front end thereof for wedging the clipping piece.

9. An electrical connector for being mounted to a printed circuit board, comprising:

an inner shell looped from a metal plate to define an accommodating chamber therein and form a joint at a substantial middle of a first top plate thereof, two sides of the first top plate being punched outward to form two hollow receiving hats;

an insulating housing fastened in the accommodating chamber;

a plurality of terminals disposed in the insulating housing;

an insulating jacket, the insulating jacket including a first frame substantially airtightly surrounding a rear of the inner shell and a covering piece protruded frontward from a middle of a front of a top part of the first frame for covering the joint of the inner shell and locating between the receiving hats; and an outer shell surrounding and electrically connecting with the inner shell, the outer shell having at least one soldering arm soldered to the printed circuit board for achieving a ground function.

10. The electrical connector as claimed in claim 9, wherein the insulating housing has a base body, the base body has a plurality of wedges protruded outward therefrom, the inner shell define a plurality of fastening holes for receiving the wedges, the insulating jacket covers the wedges and the fastening holes.

11. The electrical connector as claimed in claim 10, wherein two sides of the base body defines two positioning blocks, respectively, rear ends of two sides of the inner shell defines two gaps for receiving the corresponding positioning blocks.

12. The electrical connector as claimed in claim 9, wherein the insulating housing has a base body, a blocking wall is protruded outward from and surrounds a periphery of a rear end of the base body, a rear edge of the insulating jacket is against a front of the blocking wall.

13. The electrical connector as claimed in claim 12, wherein the outer shell includes a second top plate, the second top plate defines a mouth passing through a rear end thereof, a middle of a front end of the mouth inclines upward, and then extends rearward to form a cover, then two fixing grooves are formed adjacent to two opposite sides of the cover, respectively, a middle of a front end of the cover defines an inserting groove passing through a front end of the second top plate, a rear edge of the outer shell is against a front edge of the insulating jacket, the receiving hats are positioned in the corresponding fixing grooves, the covering piece is covered by the cover, a front end of the covering piece is extended in the inserting grooves.

14. The electrical connector as claimed in claim 13, wherein the cover of the outer shell is extended rearward to beyond a rear edge of the outer shell and cover on the first frame and the blocking wall, a rear of the cover is further connected with a rear plate which is bent downward to be engaged in a rear of the blocking wall after the outer shell is assembled.

15. The electrical connector as claimed in claim 14, wherein the rear plate of the outer shell has two soldering arms extended from two ends thereof for being soldered in the printed circuit board.

16. The electrical connector as claimed in claim 13, further comprising a waterproof rubber ring around a front end of the inner shell and against front edges of the outer shell and the covering piece.

17. The electrical connector as claimed in claim 16, wherein the waterproof rubber ring includes a second frame which is around a front end of the inner shell, a rear edge of a periphery of the waterproof rubber ring protruding outward to form a ring-shaped blocking rib abutting against the front edges of the outer shell and the covering piece.

18. The electrical connector as claimed in claim 16, wherein two ends of a rear edge of the waterproof rubber ring extend rearward to form two clipping pieces, the outer shell has two second side plates each of which defines a clipping groove passing through a front end thereof for wedging the clipping piece.

19. An electrical connector for being mounted to a printed circuit board, comprising:

an inner shell looped from a metal plate to define an accommodating chamber therein;

an insulating housing fastened in the accommodating chamber;

a plurality of terminals disposed in the insulating housing;

an insulating jacket substantially airtightly surrounding the inner shell; and an outer shell surrounding and electrically connecting with the inner shell, the outer shell having at least one soldering arm soldered to the printed circuit board for achieving a ground function;

wherein the insulating housing has a base body, a blocking wall is protruded outward from and surrounds a periphery of a rear end of the base body, rear edges of the insulating jacket and the inner shell are against a front of the blocking wall, a rear edge of the outer shell is against a front edge of the insulating jacket, and the electrical connector further comprises a waterproof rubber ring around a front end of the inner shell and against a front edge of the outer shell.

20. The electrical connector as claimed in claim 19, wherein two ends of a rear edge of the waterproof rubber ring extend rearward to form two clipping pieces, the outer shell has two second side plates each of which defines a clipping groove passing through a front end thereof for wedging the clipping piece.

* * * * *